United States Patent [19]

Schmednecht

[11] 4,379,658

[45] Apr. 12, 1983

[54] METHOD AND APPARATUS FOR CONSTRUCTING SLURRY WALLS

[75] Inventor: Fred C. Schmednecht, LaPorte, Ind.

[73] Assignee: Thatcher Engineering Corporation, Gary, Ind.

[21] Appl. No.: 212,691

[22] Filed: Dec. 3, 1980

[51] Int. Cl.[3] ..... E02D 5/20

[52] U.S. Cl. ..... 405/267; 37/80 R; 405/269

[58] Field of Search ..... 405/267, 268, 174, 179, 405/269, 258; 37/62, 80

[56] References Cited

U.S. PATENT DOCUMENTS

| | | | |
|---|---|---|---|
| 123,479 | 2/1872 | Hooton | 405/179 |
| 2,048,710 | 7/1936 | Ranney | 405/267 |
| 2,797,503 | 7/1957 | Livingston | 37/62 X |
| 3,564,855 | 2/1971 | Morner | 405/267 |
| 3,893,302 | 7/1975 | Peterson | 405/267 |

*Primary Examiner*—Dennis L. Taylor

*Attorney, Agent, or Firm*—Leydig, Voit, Osann, Mayer & Holt, Ltd.

[57] ABSTRACT

A method and apparatus for constructing a slurry wall in a trench utilizing a trenching apparatus equipped with slurry barriers behind the digging chain adapted to slidingly engage the opposite side walls of the trench from the ground level to the bottom of the trench and a trailing unit also behind the trencher straddling the trench and comprising plows near the point at which the digging chain deposits excavated soil at the ground level and a slurry injector for introducing slurry into the trench behind the slurry barriers. In a preferred embodiment, actuators are employed to shift the slurry barriers from a retracted position into an operative position.

10 Claims, 11 Drawing Figures

METHOD AND APPARATUS FOR CONSTRUCTING SLURRY WALLS

The present invention relates generally to a method and apparatus for constructing relatively shallow and intermediate depth below ground slurry walls and more particularly, concerns a method and apparatus utilizing trenching means modified and supplemented to permit slurry to be injected into the trench immediately after it is excavated.

In many instances it is necessary or desirable to construct a below ground barrier wall to isolate and protect a job site or the like from surrounding ground water seepage. In other cases such an impervious barrier wall is needed to surround water retention basins or reservoirs to keep the water in.

For some time it has been common practice to build such barrier walls by first digging a trench to the desired depth, such as by a backhoe or the like, and then filling the trench with barrier material such as a slurry formed of pulverized bentonite and cement suspended in water. Among disadvantages of this practice is a limitation in the depth to which the trench can be dug and maintained without deterioration until the trench is filled with slurry. Deterioration of the trench, especially as it is filled with slurry, results in soil inclusions within the slurry and may impair the homogeneity of the slurry necessary to create an impervious barrier.

A related disadvantage is the width to which such trenches must be excavated in order to achieve the desired depth and/or in order to avoid deterioration of the side walls. Width in excess of that required to achieve the necessary imperviousness is costly in terms of both the excavation expense and the cost of the slurry itself.

More recently, the digging of trenches per se has been obviated completely in the case of constructing slurry walls by driving a row of beams into the ground and then injecting the slurry material into the space below each beam as the beams are successively withdrawn from the row. Reference may be made, for example, to Galaup U.S. Pat. No. 3,245,222 and the patents cited therein.

In addition, applicant's co-pending U.S. application Ser. No. 710,640 discloses an improved method and apparatus for constructing slurry walls utilizing a single vibratory beam successively inserted into and extracted from the ground in overlapping positions along the path of the slurry wall. Slurry is injected at the lower end of the beam during insertion for lubrication purposes and during extraction to form the incremental segment of the slurry wall. In practice it has been found that even the single vibratory beam method and apparatus, which in virtually all applications is more economical than the use of a row of beams, is most economically employed in the construction of deep slurry walls. Accordingly, while the method and apparatus can be employed in the construction of shallow and intermediate depth slurry walls, the cost per square foot to install such a wall is greater than with deeper walls, owing in large part to the set-up time required between the successive positioning of the vibrating beam. For similar reasons, the method using a row of beams is uneconomical for shallow and intermediate depth slurry walls.

It is the primary aim of the present invention to provide an improved method and apparatus for constructing shallow and intermediate depth below ground slurry walls.

A more specific object of the present invention is to provide a method and apparatus for economically constructing shallow and medium depth slurry walls of relatively thin and homogeneous cross section.

Another object of the present invention is to employ a conventional trencher with modifications and supplementations to yield a method and apparatus for constructing shallow and medium depth slurry walls.

Yet another object of the present invention is to provide a method and apparatus for constructing slurry walls simultaneously with the trenching while avoiding both excessive excavation of the soil and waste of the slurry material.

A further object is to provide a method and apparatus which permits injection of slurry behind the digging chain while isolating the digging chain from the slurry to avoid the wasteful excavation thereof.

Still another object of the present invention is to provide a method and apparatus for injecting slurry into a formed trench while shielding the side walls.

These and other objects and advantages of the invention will become more readily apparent upon reading the following, detailed description and upon reference to the drawings in which.

While the invention will be described in connection with a preferred embodiment and procedure, it will be understood that I do not intend to limit the invention to what is shown and described. On the contrary, I intend to cover all alternatives, modifications and equivalents as may be properly included within the spirit and scope of the invention as defined by the appended claims.

Figure 1:
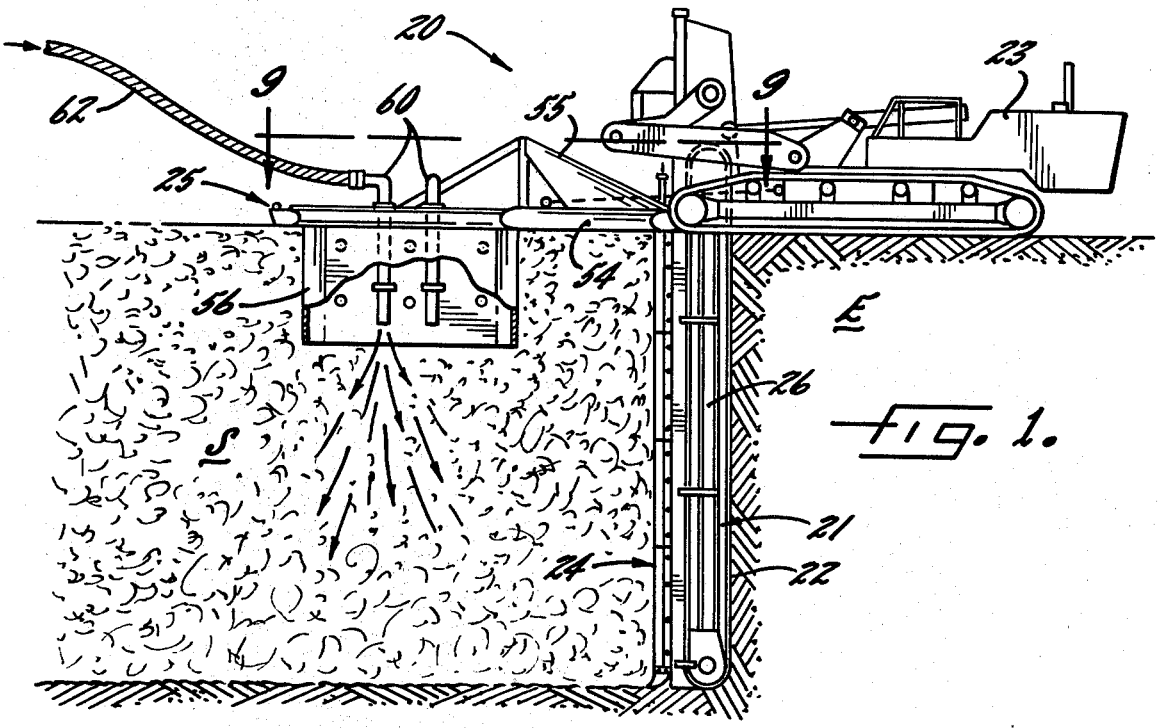
FIG. 1 is a side elevation of one from of the apparatus in operation with the earth and slurry wall shown in section along the centerline of the path of travel of the apparatus.

Referring now to the drawings, there is shown in FIG. 1 a preferred form of apparatus 20 of the present invention for constructing below ground slurry walls. The apparatus includes a trenching column 21 with digging means 22 mounted to and driven by a tracked, powered, vehicle 23. An example of such a trenching column and vehicle combination found suitable for the practice of the invention is manufactured by Steenberger-Hollandrain under its model designation BSV having a depth capacity up to 24.5 feet.

According to the invention the trenching apparatus 20 is modified and supplemented to include slurry isolation means shown generally at 24 and a trailing means 25 to effect the injection of the slurry S behind the trenching column 21 immediately after the excavating of the trench from the earth E. The slurry isolation means 24 comprises means for spanning the trench between the side walls to prevent the flow of slurry into the area of influence of the digging means 22. By maintaining such isolation the trench may be substantially completely filled immediately after its formation without waste of the slurry through its excavation back out of the trench by the digging means 22 as the soil is removed. And the virtual elimination of any time lapse between the excavation of the trench and its filling with slurry made possible by the invention is also highly advantageous in avoiding cave-ins, and general deterioration of the side walls which might occur over time. The trailing means 25 is pulled by the tracked vehicle 23. One function of the trailing means 25 is to inject the slurry into the trench. Others are to generally grade the ground surface in the immediate vicinity of the trench and to displace the excavated soil away from the trench edges to prevent re-entry of the soil into the trench.

Figure 2:
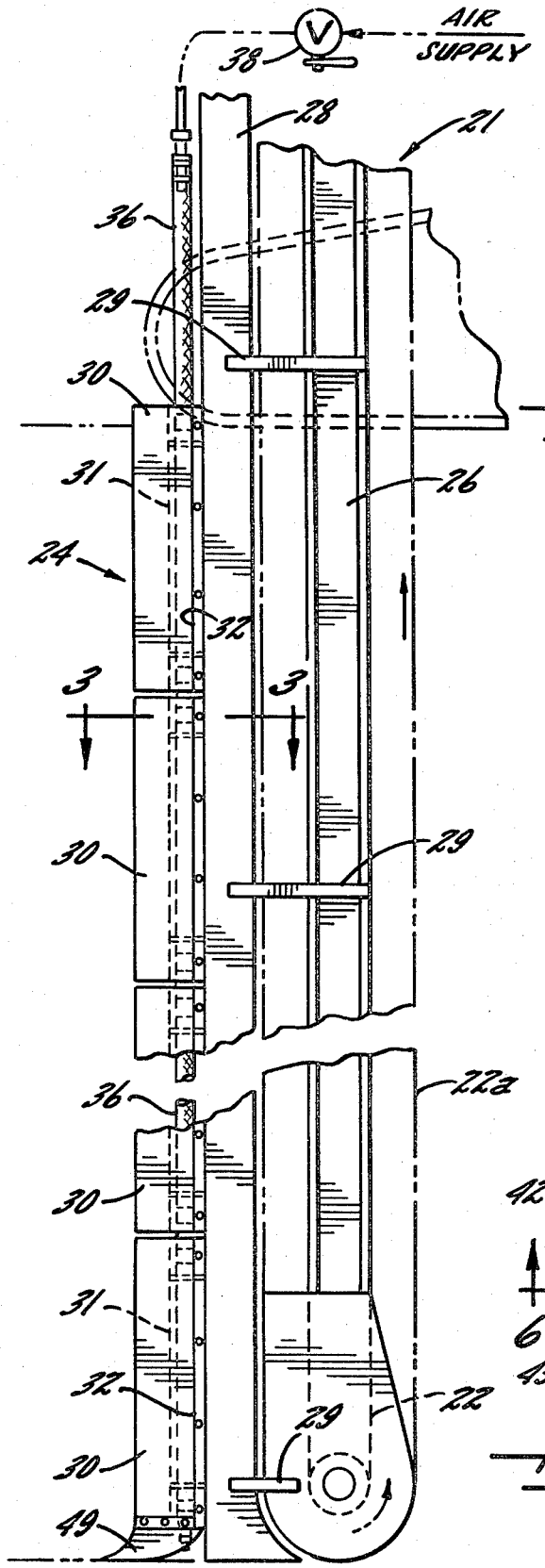
FIG. 2 is an enlarged side elevation of the top and bottom portions of the trenching column and slurry barriers attached thereto.

Considering the details of the trenching column 21, digging means 22 and slurry isolation means 24 in more detail, FIG. 2 shows an enlarged elevation. The digging means 22 is a chain-like endless conveyor to which a series of blades 22*a* (shown most clearly in FIG. 9) is mounted. A main support beam 26 establishes the elongate oval path of the digging chain 22. The blades 22*a* are pulled by means not illustrated upwardly against the unexcavated soil as the vehicle advances. The soil dislodged by the action of the blades 22*a* is carried by the blades to the ground level where it is laterally discharged by means not shown. The digging chain blades 22*a* then return to the bottom of the trench to repeat an excavation and discharge cycle.

A conventional, unmodified trenching column 21 includes a hollow feeder tube 28 mounted behind the digging chain 22 with brackets 29 extending from the main support beam 26. This feeder tube 28 is typically employed in laying flexible drainage pipe, electrical cables, etc. along the bottom of the trench as it is dug. According to the present invention, the feeder tube 28 provides a mounting surface for the slurry isolation means 24. The slurry isolation means 24 illustrated comprise slurry barriers 30 and actuation means 31. As shown in the sectional view of FIGS. 3 and 4, the slurry barriers are in the form of flaps having a relatively thin cross section. While relatively stiff, the flaps 30 are somewhat flexible so that, when urged against the side walls of the trench, they form an effective barrier to prevent slurry from flowing forward into the area of influence of the cutting chain blades 22*a*. A material which has been found suitable for the flaps 30 is polyurethane sheet having a thickness of $\frac{3}{8}$ inch and a durometer hardness of 75.

In the embodiment shown, the flaps 30 are attached along one edge 30*a* to L-shaped brackets 31 extending substantially the length of the feeder tube 28 and welded directly to its rearward-facing surface. As illustrated, the attached edges of the flaps 30 are longitudinally rigidified with metal bars 32 and angle irons 33 along the outwardly-facing and inwardly-facing edges of the flaps 30, respectively. The bars 32 and angle irons 33 also provide a zone for secure fastening of the flaps 30 to the brackets 31. While a variety of fastening techniques might be employed, a relatively simple one which has proven satisfactory is a series of bolts 34 and nuts 35 spaced along the length of the flaps and passing successively through the bars 32, flaps 30, angle irons 33 and the brackets 31. The flaps 30 and associated bars 32 and angle irons 33 may be fabricated in sections of a few feet each to facilitate installation and the replacement of worn or damaged portions.

Figure 3:
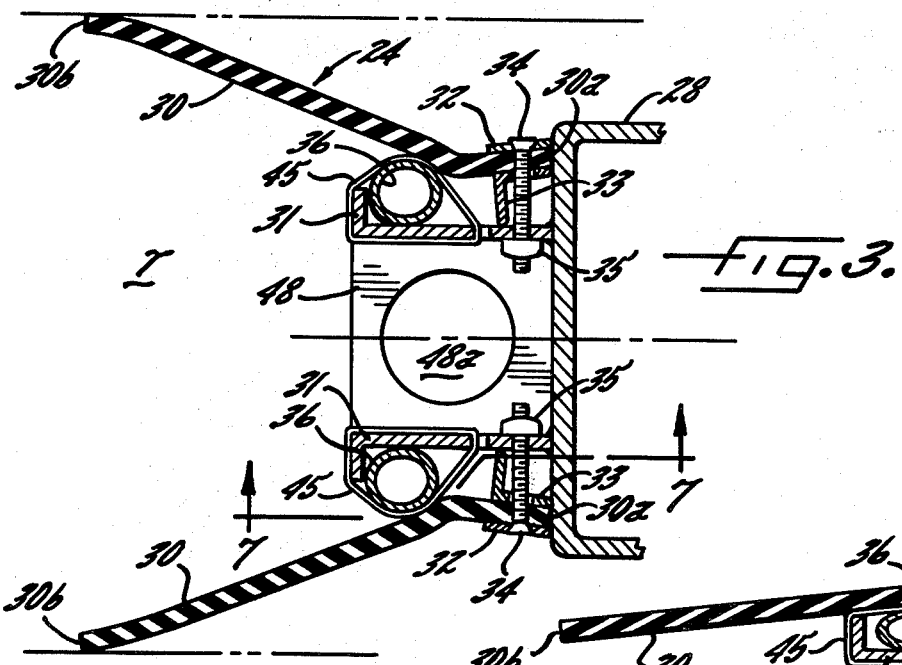
FIG. 3 is a horizontal section as seen along lines 3—3 in FIG. 2 and showing the slurry barriers in their operative positions.
Figure 4:
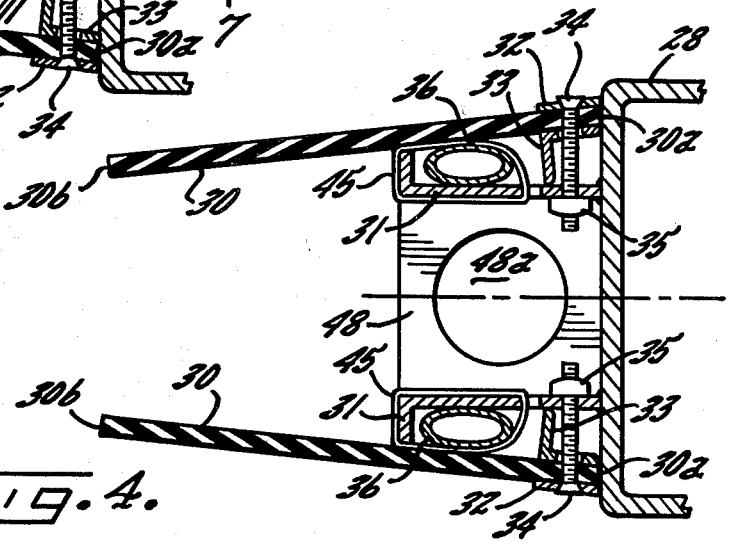
FIG. 4 is horizontal section view similar to FIG. 3 showing the slurry barriers in their retracted positions for insertion and withdrawal of the trenching column.

According to an aspect of the present invention, means are provided for actuating the flaps 30 between an operative position (FIG. 3) and a retracted position facilitating withdrawal of the trenching chain and associated structure from the trench (FIG. 4). In the embodiment shown, the actuating means are inflatable tubular members 36 oriented along the length of the flaps 30 at a position intermediate the fastened edge 30*a* and the free edge 30*b*. With the tubular members 36 inflated, as illustrated in FIG. 3, they bear against the brackets 31 and the intermediate portions of the flaps 30 and urge the portion of the flap near the free edge 30*b* outwardly. With the apparatus in operative condition in a trench depicted as T in FIG. 3, the outboard portions of the flaps 30 slidingly engage the opposite side walls of the trench from the ground level to the bottom of the trench to prevent the flow of slurrys forward past the flaps 30 toward the digging chain 22. Thus, the area of influence of the digging chain 22 is isolated from the slurry to permit it to perform its excavation function without interference from the slurry being injected only a short distance behind it.

Deflation of the tubes 36 permits the flaps to withdraw away from the planes defined by the cutting path of the digging chain 22 into the condition illustrated in FIG. 4. By mounting the flaps 30 to the brackets 31 so that they assume the retracted position shown in FIG. 4, they will automatically withdraw from engagement with the side walls of the trench once the tubes 36 are deflated. With the flaps 30 thus disengaged from the side walls of the trench, the entire trenching column 21 may be withdrawn from the trench without interference by the flaps 30. A tubular material which has proven to perform highly satisfactory for actuating the flaps 30 is flexible plastic hose having a diameter of 2 inches.

Figure 6:
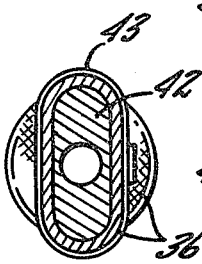
FIG. 6 is a horizontal section taken along line 6—6 of FIG. 5.
Figure 5:
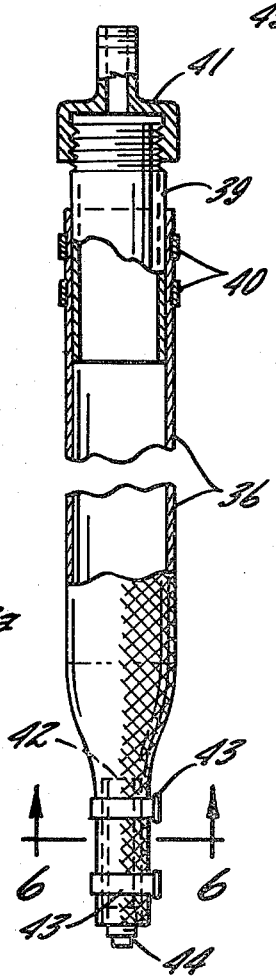
FIG. 5 is an elevational view and partial section of one of the members for actuating the slurry barriers.

In the embodiment shown, the tubes 36 are connected at their upper ends to a source of pressurized air which may be selectively applied through valve means 38 to the tubes to pneumatically expand them. Air pressure in the range of 5–7 psi has been found to be sufficient in the case of tubes made of the 2 inch flexible plastic hose mentioned above. The lower ends of the tubes may simply be plugged to permit the pressurization. An example of a tube assembly suitable for use with the present invention is shown in FIG. 5. There a short section of threaded pipe 39 is shown inserted into the upper end of the tube 36 and clamped in place with hose clamps 40. A fitting 41 adapted to interconnect with a conduit for pressurized air (not shown) is threaded onto the pipe section 39. The lower end of the tube is closed with a plug member 42 maintained in place with hose clamps 43. The plug 42 may be drilled and tapped to accept a threaded drain plug 44 which may be periodically removed to drain the tube 36 if necessary. By fabricating the plug 42 with an oblong cross section, as shown in the sectional view of FIG. 6, the drainage may be enhanced while at the same time reducing the area on which the pressurized air acts tending to expel the plug 42 from the tube 36.

Figure 7:
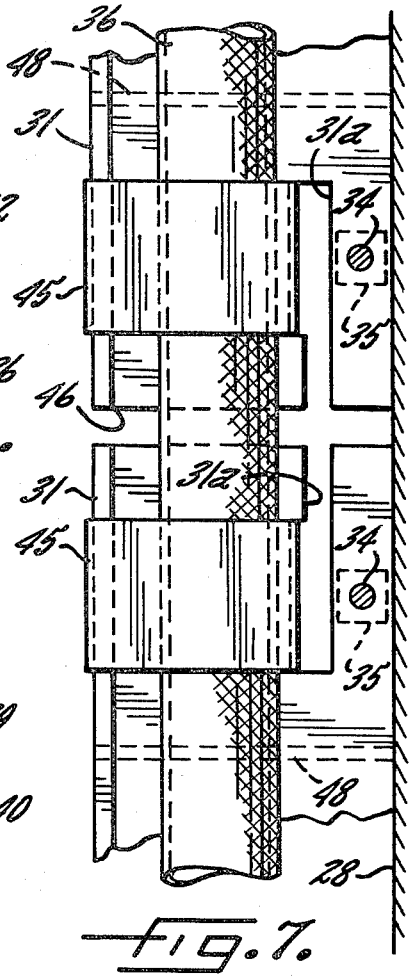
FIG. 7 is an enlarged partial side elevation of the slurry barrier actuating members mounted to the trenching column as viewed along line 7—7 of FIG. 3.
Figure 8:
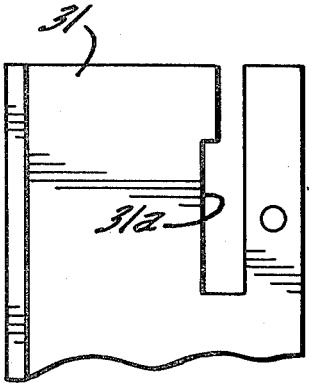
FIG. 8 is a partial side view of an actuating member mounting bracket.

The tube assemblies are held in position between the brackets 31 and the flaps 30 with stretchable bands 45. These bands are shown in place and around the tubes 36 in FIGS. 3, 4 and 7. It is advantageous to fabricate the brackets 31 in sections, and with notches 31*a* in each end (FIG. 8). Then, by mounting the brackets 31 with periodic longitudinal gaps therebetween (FIG. 7), the bands 45 may be continuous but yet removable for assembly and replacement. As already noted above, the brackets 31 may be mounted directly to the feeder tube 28, as by welding. Stiffening members 48 may be installed between the opposing brackets 31 periodically along their length to stiffen and maintain the position of the brackets 31 relative to the feeder tube 28 against the forces exerted by the tubes 36 as they expand between the flaps 30 and the brackets. Holes 48*a* in the stiffeners 48 avoid surfaces for slurry to collect upon.

In keeping with the invention, in addition to the flaps 30 for sealing against the side walls of the trench, the slurry isolation means in the apparatus shown also comprises a boot 49 disposed at the lower end of the trenching column 21 to prevent the flow of slurry underneath the apparatus toward the digging chain 22.

Figures 9, 10, 11:
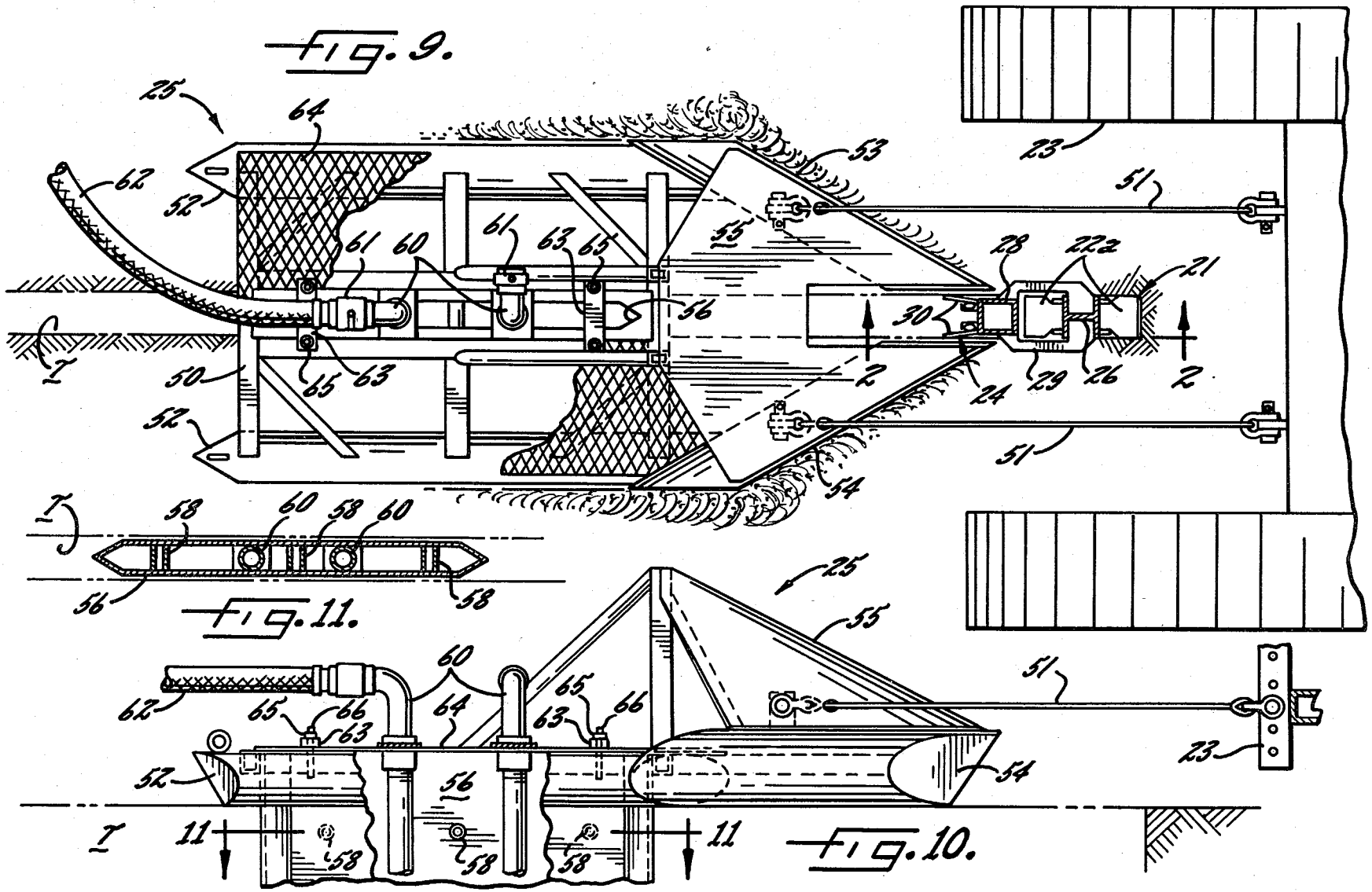
FIG. 9 is a plan view of the trailing means with a section of the trenching column and slurry barriers taken along line 9—9 in FIG. 1.
FIG. 10 is a side elevation of the trailing means shown broken away in part.
FIG. 11 is a horizontal section as seen along line 11—11 in FIG. 10.

Turning now to a consideration of the trailing means 25, plan and elevational views are shown in FIGS. 9 and 10. In the embodiment illustrated, a portion of the trailing means is a sled 50 towed behind the trencher vehicle 23 with cables 51. The sled comprises runners 52 straddling the excavated trench and plow members 53 and 54 on each side of the trench T extending rearwardly and outwardly from a point just behind the digging chain 22 to points at the outboard edges of the runners. With such a configuration, as the apparatus 20 advances with the digging chain 22 in operation, the excavated soil deposited at the top edges of the trench T will be displaced laterally away from the trench to generally grade the ground near the trench and to prevent reentry of the excavated soil into the trench. The trailing sled 50 shown also includes a deflection shield 55 to prevent the accumulation of soil on the sled itself.

According to another aspect of the invention, the trailing means also comprises a removable slurry box 56 for injecting slurry into the trench T as the sled is pulled behind the operating trenching apparatus. The slurry box 56 serves to direct the slurry downwardly into the trench while shielding the upper side walls of the trench from erosion resulting from the slurry injection. To this end, the slurry box 56 has the configuration of a flattened tube when viewed from the top, with closed sides and an open bottom. FIG. 11 illustrates a horizontal cross section of the slurry box 56 at a point below the ground. Several stiffening members 58, shown fabricated from short sections of pipe, support the sides of the slurry box to maintain its shape. The slurry box 50 should have a width somewhat less than the cutting path of the digging chain 22 to avoid scraping the side walls of the trench and to allow the slurry box to be advanced in a slurry-filled trench. Moreover, the leading and trailing ends of the slurry box 56 may be streamlined as shown in the section of FIG. 11 to reduce resistance as it is being pulled through the slurry.

The slurry box 56 is shown with two slurry inputs 59 entering the otherwise closed top of the slurry box. While only one slurry input 59 might be employed, it is advantageous to have a standby source of slurry (not shown) connected and ready for injection immediately upon depletion of the on-line source (also not shown). Such a standby arrangement avoids interruptions in the slurry flow which might otherwise affect the continuity of the slurry wall being constructed.

At their upper ends the slurry inputs 59 comprise swivel elbows 60 with couplings 61 to connect with a slurry supply line 62. The discharge ports of the slurry inputs 59 are below the ground level but above the bottom edge of the slurry box 56. With such an arrangement the slurry is prevented from impinging directly onto the side walls of the trench and eroding them.

The entire slurry box 56 is removable as a unit from the sled 50 to facilitate the handling and transportation of the sled when not in operation. In the embodiment shown, spanner bars 63 support the slurry box 56 from the deck 64 of the sled 50. Removal of the slurry box 56 is readily accomplished by removing the nuts 65 securing spanner bars 63 to threaded studs 66 projecting upward from the deck 64 of the sled. The slurry box 56, which may be fabricated of relatively lightweight sheet material, may then be lifted out of the trench T as a separate unit. Then the heavier sled 50, having had its "keel" removed, may then be shifted laterally from its position straddling the trench T without substantial lifting.

From the above description, the operation of the apparatus 20 will be readily understood. During operation, with the digging chain 22 in operation and being advanced by the vehicle 23, the tubular members 36 are inflated to urge portions of the flaps 30 against the side walls of the trench. The flaps 30 slidingly engage the trench side walls to create a barrier between the portion of the trench behind the trenching column 21 and the digging chain 22. The trailing means 25 plows back the excavated soil and injects slurry into the newly formed trench. Upon termination of the trenching operation, the slurry box 56 may be readily removed from the sled 50 to permit the shifting of the sled from its operative position straddling the trench. The deflation of the actuating tubes 36 allows the flaps 30 to retract out of contact with the trench side walls. The trenching column 21 may then be swung up out of the trench without interference by the flaps 30.

I claim as my invention:

1. An apparatus for constructing a slurry wall in a trench comprising, in combination:

a. a trencher including driving means and a trenching column, the trenching column having a digging chain to excavate soil to form a trench as the trencher is advanced;

b. a slurry isolation means disposed immediately behind the trenching column, the slurry isolation means adapted to slidingly engage the opposite side walls of the trench from the ground level to the bottom of the trench; and c. trailing means towed by the driving means and including (i) plow means extending rearwardly and outwardly with respect to both sides of the trench from a point just behind the digging chain in close proximity to the slurry isolation means for displacing the excavated soil laterally away from the formed trench and (ii) slurry injection means for introducing slurry material into the trench behind the slurry isolation means whereby a slurry wall may be constructed simultaneously with the excavation of the trench, and the slurry isolation means prevent the slurry from entering the area of influence of the digging chain.

2. The apparatus of claim 1, the slurry isolation means including:

elongate barriers each attached to the trenching column behind the digging chain along lines generally parallel to the planes defined by the cutting path of the digging chain; and actuation means to urge a portion of the barriers outwardly toward the planes defined by the cutting path of the digging chain whereby in operation the barriers slidingly engage the opposite side walls of the trench from the ground level to the bottom of the trench and isolate the area of influence of the digging chain from the slurry.

3. The apparatus of claim 2, the elongate barriers including flexible flaps attached along one of their elongate edges to the trenching column along a line generally parallel to and spaced from the planes defined by the cutting path of the digging chain, the actuation means urging a portion of the flaps near their other elongate edges toward the digging chain cutting planes.

4. The apparatus of claim 3, the flexible flaps being formed of polyurethane sheet material.

5. The apparatus of claim 3, the actuation means including inflatable tubular members.

6. The apparatus of claim 5, the tubular members being formed of flexible plastic hose.

7. The apparatus of claim 1, the means for injecting slurry into the trench including a slurry discharge port and a slurry box, the slurry box having substantially closed sides and an open bottom, the slurry box further having a width less than the width of trench formed by the trencher and being mounted to the trailing means to extend below the ground level into the trench, the discharge port communicating with the slurry box above the bottom edge thereof, whereby the slurry box directs the slurry downwardly into the trench while shielding the trench walls from the slurry as it is discharged from the discharge port.

8. The apparatus of claim 1, the trailing means including a sled pulled by the trencher, the sled including runners spaced to straddle the trench as the sled is pulled behind the trencher.

9. The apparatus of claim 1, the slurry injection means extending downwardly beyond the ground level and adapted to travel in the trench formed by the trencher, the slurry injection means being removably mounted to the trailing means to permit the trailing means to be moved laterally from above a formed trench without substantial lifting after removal of the slurry injection means.

10. A method for constructing a slurry wall in a trench simultaneously with the excavation thereof comprising the steps of:

a. excavating a trench with a trencher comprising a trenching column including a digging chain;

b. forming a slurry isolation means behind the digging chaing between the trench side walls and the trenching column and grading the ground surface just behind the slurry isolation means and displacing the graded and excavated soil away from the trench to thereby prevent re-entry of the soil into the trench; and c. injecting slurry material into the excavated trench behind the slurry barrier whereby the slurry isolation means prevents the slurry from entering the area of influence of the digging chain.

* * * * *